US005183233A

United States Patent [19]

LaPalomento

[11] Patent Number: 5,183,233

[45] Date of Patent: Feb. 2, 1993

[54] UNIVERSAL FIXTURE SUPPORT

[76] Inventor: Joseph LaPalomento, 1221 Dennis St., Angleton, Tex.

[21] Appl. No.: 698,136

[22] Filed: May 10, 1991

[51] Int. Cl.[5] ..... B42F 13/00

[52] U.S. Cl. ..... 248/343; 52/39

[58] Field of Search ..... 248/342, 343, 27.1, 248/906; 52/39, 38, 118; 362/363; 220/3.9

[56] References Cited

U.S. PATENT DOCUMENTS

| | | | |
|---|---|---|---|
| 805,509 | 11/1905 | Wright | 248/345 X |
| 1,270,296 | 6/1918 | Jeune | 248/343 X |
| 2,130,307 | 9/1938 | McGovern | 248/345 X |
| 2,157,957 | 5/1939 | Heise | 248/245 X |
| 2,215,331 | 9/1940 | Marsh | 248/345 X |
| 4,122,857 | 10/1978 | Haerr | 248/205.3 X |
| 4,410,160 | 10/1983 | Alperin | 248/342 X |
| 4,682,452 | 7/1987 | Propp | 52/118 |
| 4,993,994 | 2/1991 | Ojima | 220/307 X |
| 5,024,412 | 6/1991 | Hung | 220/3.9 X |
| 5,034,869 | 7/1991 | Choi | 362/363 |

*Primary Examiner*—J. Franklin Foss
*Attorney, Agent, or Firm*—John Lezdey

[57] ABSTRACT

The invention provides a support for hanging an electrical fixture to a ceiling or wall and a method for suspending the fixture. The support comprises a novel panel which is intended to be affixed to the grid work of a house and a support affixed to the panel which holds the electrical fixture. A slot is provided on the rear of the panel to hold the panel flush against a flat surface by carry therein wiring.

11 Claims, 2 Drawing Sheets

UNIVERSAL FIXTURE SUPPORT

FIELD OF THE INVENTION

The present invention relates to a support for affixing an electrical fixture to a ceiling or wall. More particularly, the invention provides a means for suspending a heavy electrical fixture such as a fan or lamp, from a ceiling or wall so as to provide support for the fixture and to allow easy placement by a worker.

BACKGROUND OF THE INVENTION

In the past, a wide variety of systems and brackets have been provided for hanging light fixtures from room ceilings. A typical lighting fixture, however, is today hung directly to an electrical box. The electrical box is wired so that the lighting fixture can be wired directly to the wires therein. A fixture strap can be threaded directly across the electrical box and the lighting fixture canopy threaded to the fixture strap to support the hanging light fixture thereon.

A second common technique for hanging lamps directly to an electrical box uses a threaded lamp hickey attached to a threaded stud in the center of the electrical box. A threaded nipple can then be attached to the hickey with a lock-nut and the canopy can be slid over the threaded nipple and a collar threaded attached thereto for holding the hanging lamp fixture.

A third technique used in wall-mounted fixtures attaches a fixture strap to a rectangular wall electrical box and then attach a nipple extending through the wall fixture to hold the fixture with a center nut threaded to the nipple. Some simpler ceiling lighting fixtures are tab mounted and are attached with mounting screws passing directly through the canopy into the electrical box threaded tabs.

Elongated standard traversely adjustable lighting tracks for use on ceilings and walls have been known for many years. Lighting fixtures of this type are commonly secured by mounting the track against the drywall of the ceiling or wall wherein the lighting fixture is to be secured. Such securement is commonly by screws passing through the track into the studs of a wall or ceiling joists as the case may be, appropriate wiring is passed through the backside of the track in contact with the wall or ceiling through the sheetrock and into an appropriate junction box. In many cases, the wall or ceiling joists are not found at the appropriate locations where the screws are intended to be placed. Without attachment to the joists, the load of the fixture maybe too heavy for the drywall so that the fixture may fall.

Additionally, there are no fixture supports for heavy light fixtures which are decorative and can cover large areas when needed.

Prior to the present invention the hanging of heavy ceiling fixtures required suspension of the fixture directly from ceiling joists. This at times resulted in the fixture being located unsymmetrically in a room. Also more than one person was required to operatively attach the fixture since supports were not generally provided to hold the fixture while wiring and/or affixing it to the ceiling.

It is to be understood that the term "grid" as used herein are the structural elements in walls or ceilings to which a drywall of a ceiling or wall are fastened. The term "grid" includes joists, crossbeams, suspended ceiling grids, wall studs and the like.

SUMMARY OF THE INVENTION

The present invention relates to a universal electrical fixture hanging system for suspending an electrical fixture from a flat surface having a supporting grid. The hanging system comprises the combination of a flat panel and a support for the electrical fixture. The flat panel has a series of apertures and is shaped for attachment to the supporting grid work for a ceiling or wall, for example, the joists of a ceiling. The panel is provided with a central opening through which wires from an electrical source can pass for connection with the wires of the electrical fixture. On the side of the panel facing the flat surface, there is a slot which runs through the central opening for inserting wire from the electrical source so as to permit the panel to be flush with the wall or ceiling.

A support for the fixture is attached to the panel. The support is provided with an opening which is aligned with the central aperture of the panel. The support is also provided with means for holding the fixture while the fixture is being wired to a source of electricity.

The panel can be in any desired shape and is preferably provided with a decorative face.

Alternatively, a decorative cover may be used over the panel which can be attached to the panel or held in place over the panel by the support.

In lieu of a cover, a decorative design may be molded onto the panel.

The invention also provides a novel and efficient method for suspending an electrical fixture from a ceiling or wall using the present support system. According to the method, the panel with the support is fastened to a ceiling or wall grid, for example, a ceiling joist. An electrical fixture is suspended on the support so as to permit operative connection with a source of electricity.

When the central opening of the panel is not aligned with the opening in the surface of the ceiling or wall exposing the wires from the electrical source, the wires from the electrical source are inserted into the slot on the back of the panel so that the panel could be flush with the surface. Advantageously, the wires are held in the slot by adhesive means. The fixture is then operatively connected.

It is therefore an object of this invention to provide a support for suspending an electrical fixture from a wall or ceiling.

It is another object of the invention to provide a means for suspending an electrical fixture from a ceiling which can be managed by one person.

It is still a further object of the invention to provide a suspension system which can be used with a wide variety of ceilings or walls and with a wide variety of electrical fixtures.

It is yet another object of the invention to provide a method for suspending an electrical fixture from a wall or ceiling which requires only a single person.

Other features of the invention, and advantages associated with such features, are hereinafter discussed as a part of the description of the illustrated embodiments.

BRIEF DESCRIPTION OF THE DRAWINGS

Like reference numerals are used to designate like parts throughout the several views of the drawings, and.

DESCRIPTION OF THE PREFERRED EMBODIMENTS

Figure 1A:
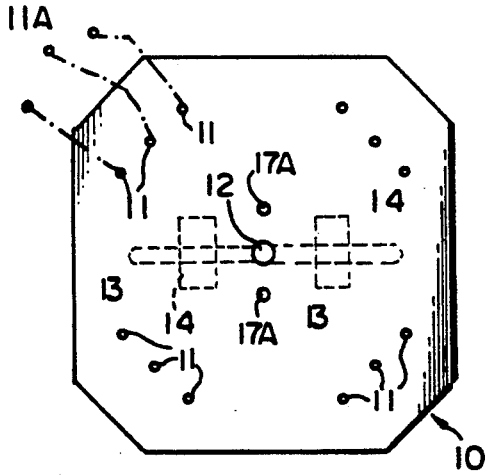
FIG. 1A and 1B illustrate the front and rear of a panel of the invention.

The objects of the present invention can be achieved by providing a universal fixture support comprising a panel 10 with a support 15 for an electrical fixture as shown in the drawings.

As seen in FIGS,. 1A and 1B, the panel 10 comprises a flat member having a series of apertures 11 along its sides for fastening the panel 10 with fasteners such as nails and screws to a grid structure in a house such as crossbeams, joists, and the like, of a ceiling. The apertures 11 are so spaced as to allow use of the panel on joists or other grid structures which may be irregularly spaced. Preferably, the apertures are countersunk to allow use of buttons 11A to cover over the apertures for aesthetic appearance.

The panel 10 is provided with an opening 12 about its central portion through which wires from an electrical source extend for attachment to the electrical fixture to be suspended.

Preferably, the panel 10 is provided with partial bores 17A for screw holes to expedite attachment of the support 15 to the panel 10.

Figure 1B:
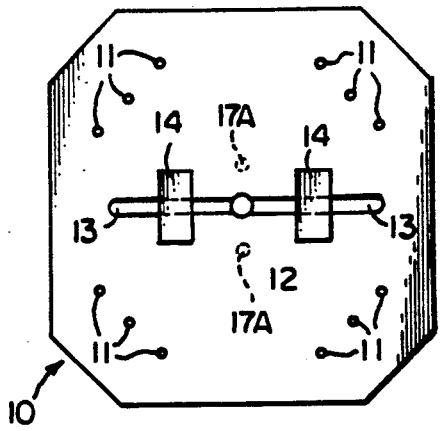

As shown in FIG. 1B, there is provided a slot 13 which runs through opening 12 so as to insert extending wires to insure that the panel is flush with a surface. The slot 13 is particularly useful in the event the opening 12 is not in alignment with an opening in a wall or ceiling through which the electrical wires from the source of electricity is found. The slot 13 permits movement of location of the panel 10 without reboring the walls or ceiling.

Optionally, adhesive tapes 14 are provided to hold the wires in the slot 14 during attachment of the panel 10 to the desired surface.

The panel 10 is preferably formed from wood but any other material such as plastic, plaster or the like can be used. The panel 10 can take any shape and can have a decorative face.

Figure 2:
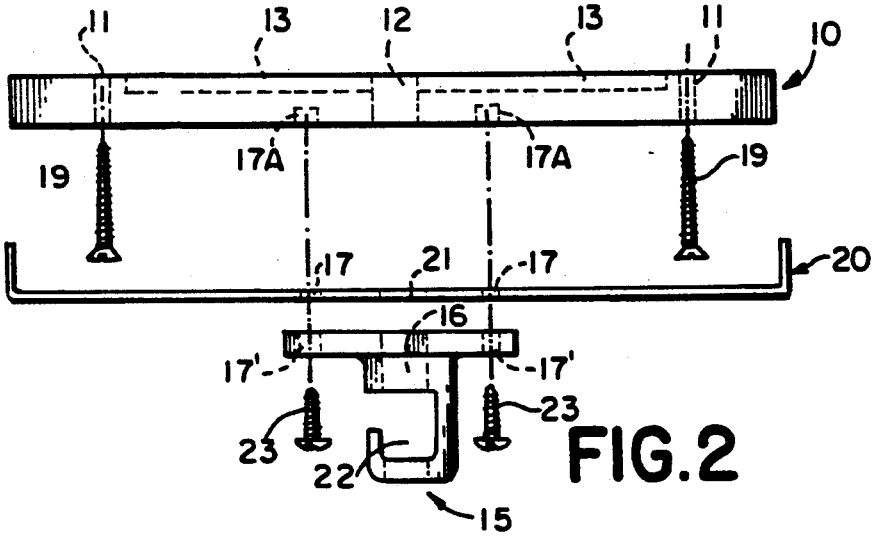
FIG. 2 shows an elevational view of the panel of FIGS. 1A and 1B with decorative cover and an electric fixture support.

As shown in FIG. 2, the universal support of the invention is provided with a support 15. The support 15 is shown as a J-hook which is preferably for use in connection with ceiling fans. However, the particular support 15 which is used will largely depend upon the particular fixture to be suspended. The support 15 can be provided by the manufacturer of the fixture to be suspended, in which event, the partial bores 17A in the panel 10 can be made by the fixture manufacturer.

A decorative cover 20 can be used if desired to provide the universal support with an aesthetic appearance. The cover 20 is provided with an opening 21 which aligns with opening 12 of the panel 10.

A support 15 is also provided which is illustrated in the drawing in the form of a J-support for an electric ceiling fan. The support 15 is fastened to the panel 10 by means of screw-fasteners 23 which are placed through holes 17' of the support 15, holes 17' of the cover 20 and prebores 17A of the panel 10. In FIG. 2 the cover 20 is shown as being held in place by the attachment of the support 15 to the panel 10. However, it is possible to construct a cover 20 which clips onto the panel 10 or is separately fastened to the panel without support from the support 15.

The support 15 is provided with on opening 16 which is in alignment with the opening 12 when the support 15 is attached to the panel 10. A cut out portion 22 and an opening 16' of the support 15 permits a fixture to be suspended from the support 15. Typically, the universal support of the invention is purchased by a consumer unassembled. The panel 10 is affixed to a surface such as a ceiling. The cover 20 and the support 15 which is specific for the fixture is secured to the panel 10. An electrical fixture is then suspended on this support 15 for operative connection to electrical wires.

Figure 3:
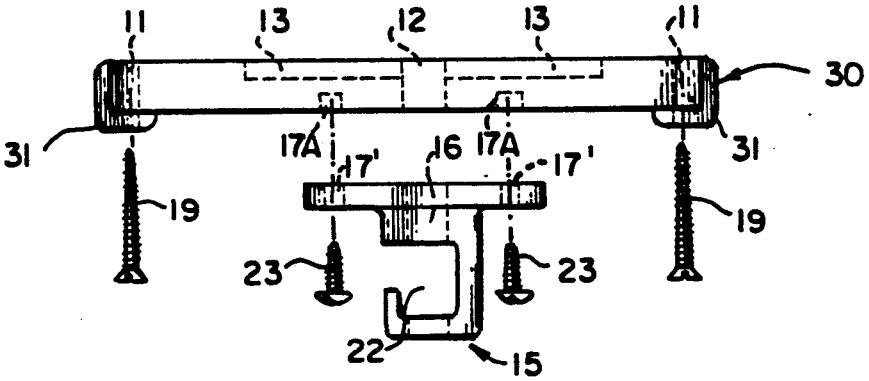
FIG. 3 shows an elevational view of the panel of FIGS. 1A and 1B with decorative molding on its face and a fixture support, and FIG. 4 schematically illustrates a fan which is attached to a ceiling with a hanging system of the invention.

As seen in FIG. 3., the panel 10 need not have a decorative cover 15 but can be provided with a decorative molding 31. The molding 31 can be cast on the panel 10 using conventional molding methods. The molding 31 can be a plastic, such as styrofoam, plaster, or the like.

Figure 4:
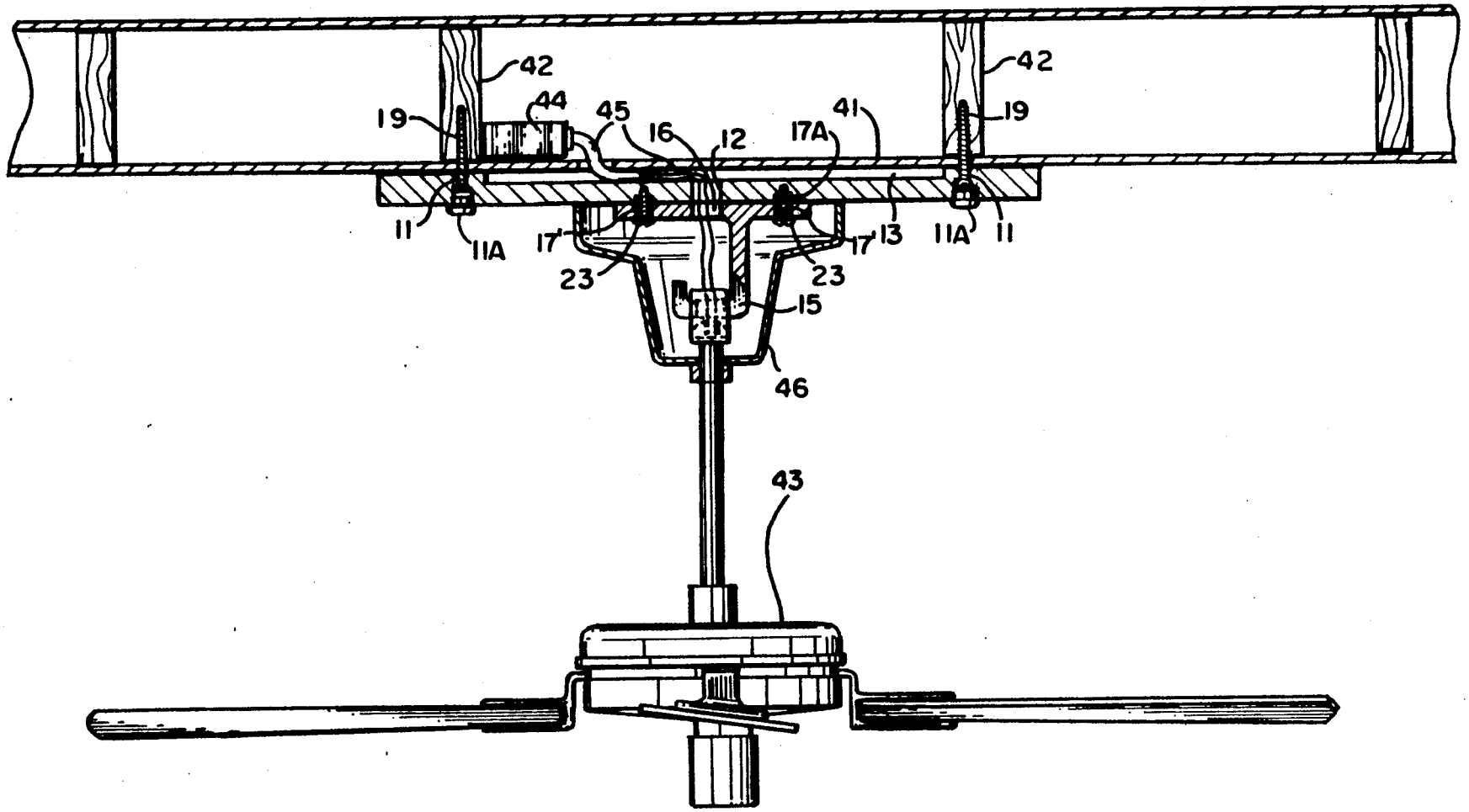

As shown in FIG. 4, the universal electrical fixture support of the invention is used to suspend an electrical fan 43 from the ceiling 41. In this illustration the fan is suspended away from the electric box 44 and between a pair of joist 42. As seen, screws 19 are driven into joists 42 so as to hold the panel 10 flush against the ceiling. The wire from the electric box 44 for connection to the fan 43 is run through slot 13. The support 15 is affixed to the panel 10 with screws 23. A cover 46 over the support 15 provides a further aesthetic appearance. The cover 46 can also be held in place by directly fastening the cover 46 to the panel 10.

With the universal support of the invention, a single operator can suspend a heavy fixture from a wall or ceiling by himself. All that is required is that the panel 10 of the invention be placed so that the precut apertures can be used to insert fasteners 19 to be driven into the grid works of the wall or ceiling 41, for example, ceiling joists 42. The specific support 15 for the fixture 43 can be affixed to the panel 10 before or after the panel 10 is affixed to the joists 42. If the central opening of the panel 10 is not aligned with the opening in the ceiling or wall through which the electrical wires protrude, the wires are inserted into the slot 13 so that the panel 10 lies flush against the surface. While the fixture is suspended from the support 15, the operator can use both hands to attach the wiring to make the fixture operative and to complete the installation of the fixture.

The universal support for hanging an electrical fixture of the present invention has been described in respect to the embodiments shown in FIGS. 1–4 and set forth in the preceding specification, it being understood that other variations and modifications thereof will now become apparent to those skilled in the art. Accordingly, the scope of the invention is to be interpreted not in view of the particular embodiments disclosed and described but in view of the appended claims.

What is claimed is:

1. A universal electrical fixture hanging system for suspending an electrical fixture from a flat surface having a grid comprising in combination:

a flat panel having a series of apertures to receive fasteners therein and shaped to be attached to said grid;

said panel having a central opening through which wires from an electrical source pass and a slot on its rear said passing through said central opening;

said slot being adapted to receive a wire to allow placement of said panel flush with said flat surface;

a support means for said fixture detachably mounted to said panel over said central opening for supporting said fixture, said support means having an opening aligned with said central opening on said panel and a hook element for supporting said fixture to permit attachment of wires from said fixture to the wires from said electrical source.

2. The universal hanging system of claim 1 wherein the apertures of said panel are countersunk and buttons are provided for said apertures.

3. The universal system of claim 1 wherein the front side of said panel is decorative.

4. The universal hanging system of claim 1 including a cover over said panel, said cover having an opening aligned with the opening of said panel and being mounted between said panel and said support.

5. The universal hanging system of claim 1 including a decorative molding on the front side of said panel.

6. The universal hanging system of claim 1 wherein said panel comprises wood.

7. The universal hanging system of claim 1 including an electrical fixture suspended from said support.

8. A method for operatively suspending an electrical fixture from a flat surface having a grid and a source of electricity comprising the steps of:

attaching the universal hanging system of claim 1 to said grid with fasteners;

placing an electrical fixture on the support of said hanging system, then connecting wires from the electrical fixture to the wires from an electrical source.

9. The method of claim 8 including the steps of inserting the wires from said electrical source into the slot on said panel prior to attachment of the panel to said grid.

10. The method of claim 9 wherein said wires from said electrical source are adhesively held within said slot.

11. The method of claim 8 wherein said grid is a ceiling joist.

* * * * *